US007428970B2

(12) United States Patent
Chen

(10) Patent No.: US 7,428,970 B2
(45) Date of Patent: Sep. 30, 2008

(54) TOOL RACK FOR TOOL BOXES

(76) Inventor: Chang-Ying Chen, No. 5, Alley 320, Shi Hu Road, Tali Hsiang, Taichung Hsien (TW)

( * ) Notice: Subject to any disclaimer, the term of this patent is extended or adjusted under 35 U.S.C. 154(b) by 534 days.

(21) Appl. No.: 11/258,062

(22) Filed: Oct. 26, 2005

(65) Prior Publication Data

US 2007/0090008 A1 Apr. 26, 2007

(51) Int. Cl.
*B65D 85/28* (2006.01)

(52) U.S. Cl. ..... 206/372; 206/379; 206/759

(58) Field of Classification Search ..... 206/372, 206/373, 349, 377–379, 759, 762, 765; 211/69
See application file for complete search history.

(56) References Cited

U.S. PATENT DOCUMENTS 4,598,822 A * 7/1986 Hemmings ..... 206/379
5,190,154 A * 3/1993 Reusch ..... 206/375
5,535,882 A * 7/1996 Liu ..... 206/377
5,669,492 A * 9/1997 Chao ..... 206/234
6,050,409 A * 4/2000 Delbeck et al. ..... 206/375
6,415,923 B1 * 7/2002 Chen ..... 206/379
6,547,074 B1 * 4/2003 Chen ..... 206/379
2004/0084341 A1 * 5/2004 Amtenbrink ..... 206/372
2004/0188279 A1 * 9/2004 Chen ..... 206/216
2004/0188366 A1 * 9/2004 Tong ..... 211/70.6
2005/0161356 A1 * 7/2005 Chen ..... 206/373
2006/0016706 A1 * 1/2006 Chen ..... 206/379

* cited by examiner

*Primary Examiner*—Mickey Yu
*Assistant Examiner*—Jose S Stephens, III

(57) ABSTRACT

A tool box includes a base with a pivotable cover and a tool rack is securely connected to the cover so that when the cover is pivoted to open position, the rack is pivoted with the cover. A shaft rotatably extends through the tool rack and includes a plurality of notches which are located corresponding to through holes defined in the rack. Each notch includes two inclined surfaces so as to clamp a side of an end of the tool inserted into the through hole. By this specific arrangement, the tools are well positioned and do not shake.

8 Claims, 9 Drawing Sheets

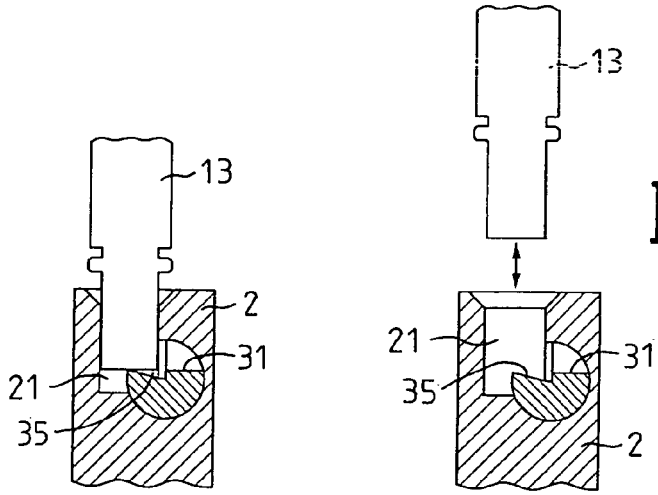
FIG. 2-1
FIG. 2-2
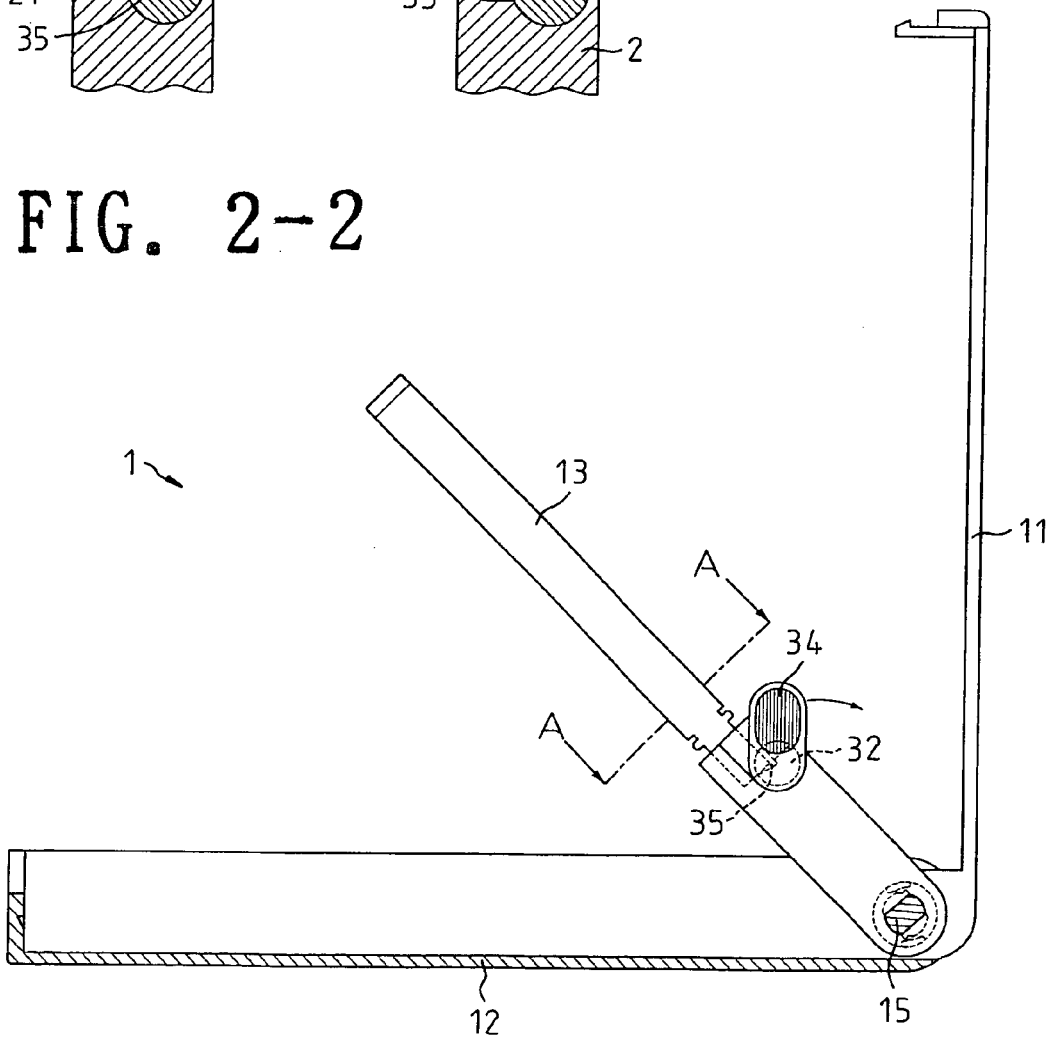
FIG. 3

TOOL RACK FOR TOOL BOXES

FIELD OF THE INVENTION

The present invention relates to a tool box with a tool rack which includes a shaft with notches for clamping respective sides of tools so that the tools do not shake in the tool box.

BACKGROUND OF THE INVENTION

A conventional tool box generally includes a base and a cover which is pivotably connected to the base and the base and/or the cover include a plurality of notches defined in an inside thereof so that tools can be securely snapped with the notches. In order to include as many as notches, the notches are made slightly longer than the tools so that users has to pick the tools by a finger from a small gap between the tool and the notch. Some tool boxes include tool racks which are pivotably connected to the base and each rack includes notches for receiving tools. In order to securely position the tools in the racks, the sizes of the notches are designed so that the tools are force fitted into the notches. The users are still different to pick the tools out by fingers. Some tool boxes have sufficient space for receiving the tools, however, the tools shake when carrying the tool boxes and made a lot of noise.

The present invention intends to provide a tool rack in tool box and a shaft with notches is rotatably connected to the rack such that the tools are clamped by the notches when the tool box is closed. When the shaft is rotated in one direction, the tools are pushed out from the notches and the user can easily pick the tools from the tool rack.

SUMMARY OF THE INVENTION

The present invention relates to a tool box that comprises a base and a cover pivotably connected to two sides of the base by two connection members. A tool rack is connected to the two connection members which are securely connected to the cover. A plurality of through holes are defined through the tool rack so that tools may end through the through holes. A shaft rotatably extends through the tool rack and includes a plurality of notches which are located corresponding to the through holes when the shaft is rotated at a storage position. The notch clamps a side of a tool inserted in the notch.

The present invention will become more obvious from the following description when taken in connection with the accompanying drawings which show, for purposes of illusion only, a preferred embodiment in accordance with the present invention.

BRIEF DESCRIPTION OF THE DRAWINGS

FIG. 2-1 is a cross sectional view to show that the tool is to be engaged with the notch of the shaft;

FIG. 2-2 is a cross sectional view to show that the tool is inserted in the through holes of tool rack;

FIG. 2-3 is a cross sectional view to show that the shaft is rotated to clamp the tool;

FIG. 3 shows that the cover is pivoted to open position and the lever of the shaft is rotated to push the tool upwards;

FIG. 5-1 shows that the shaft is not yet rotated to clamp the tools;

FIG. 5-2 shows that the shaft is rotated to clamp the tools;

FIG. 7-1 shows another embodiment of the tool rack which clamps screw bits;

FIG. 7-2 shows that the cover is opened and the tool rack is pivoted with the cover;

DETAILED DESCRIPTION OF THE PREFERRED EMBODIMENT

Figure 1:
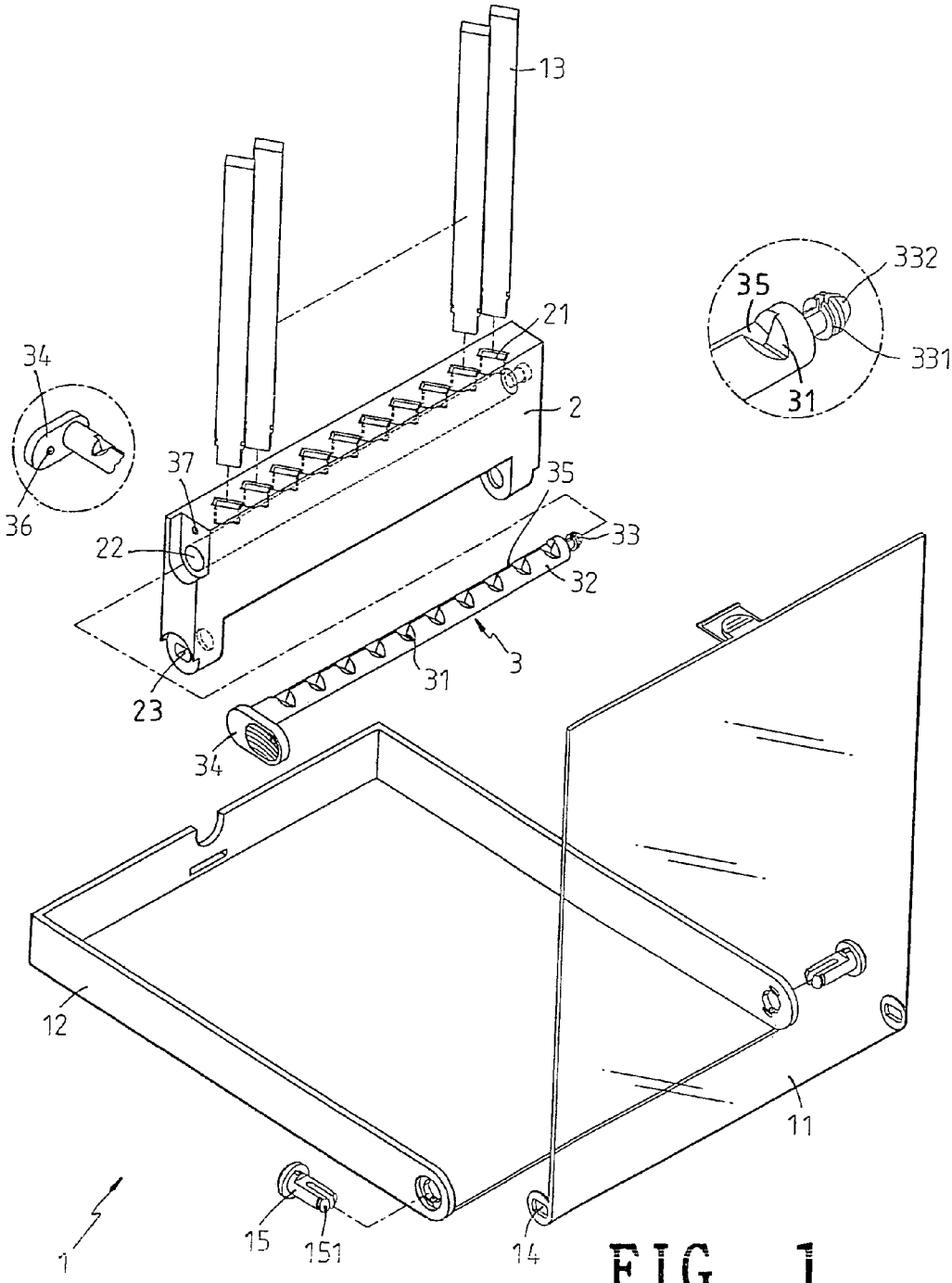
FIG. 1 is an exploded view to show the tool box of the present invention.
Figure 6:
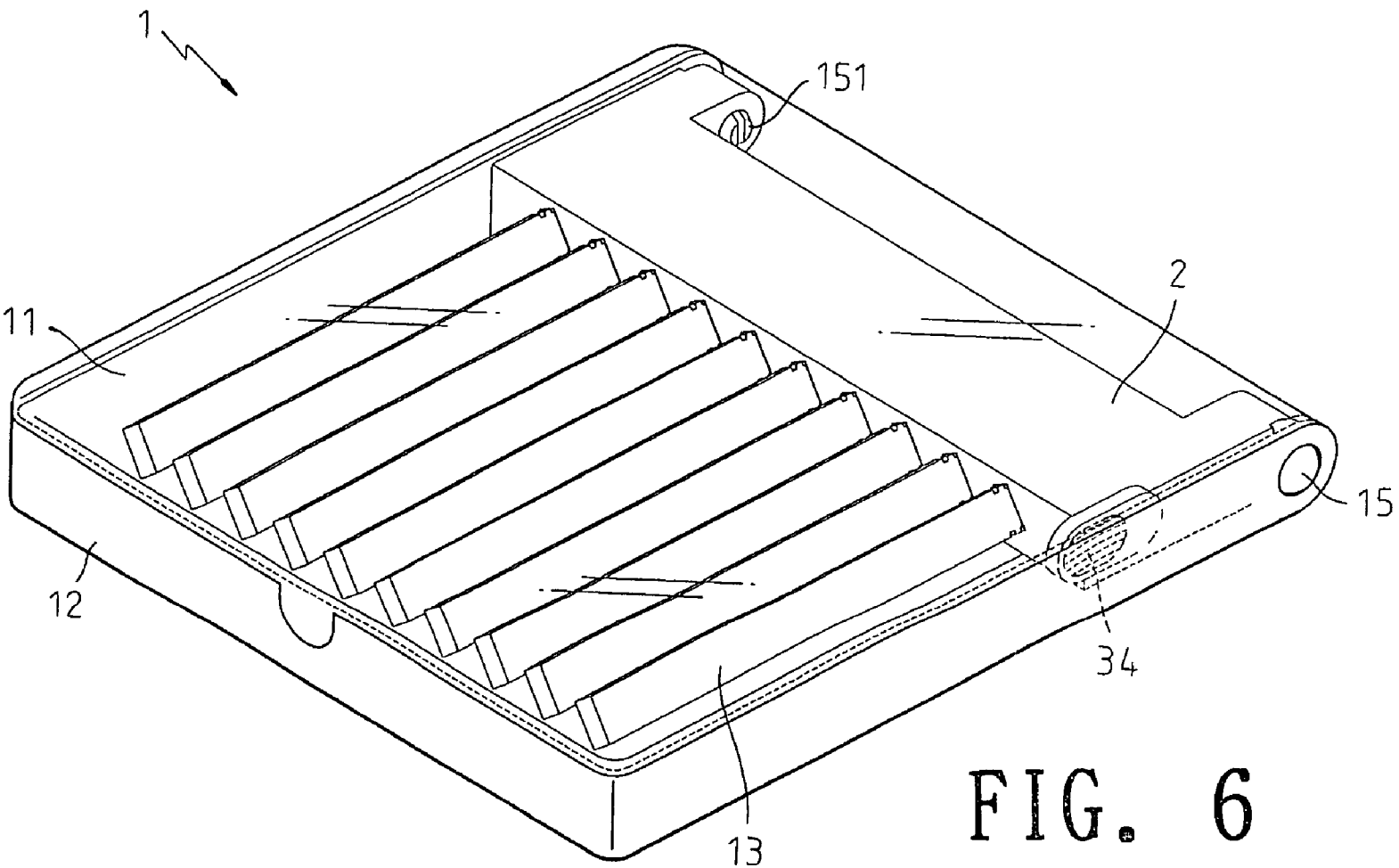
FIG. 6 is a perspective view to show the tool box of the present invention.
Figures 1, 7:
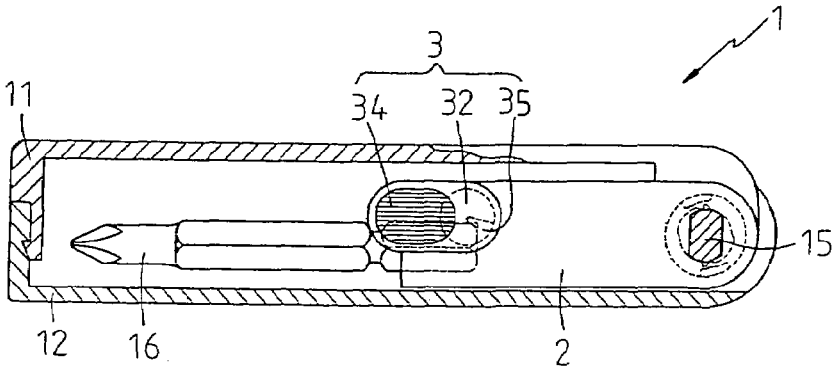
Figures 2, 7:
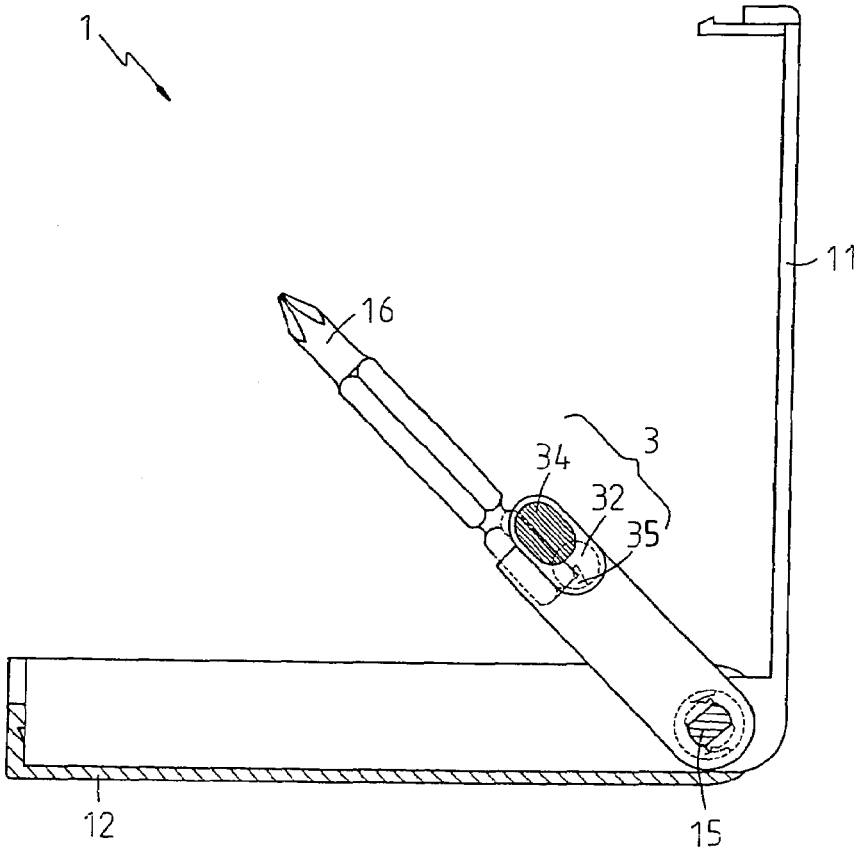
Figure 8:
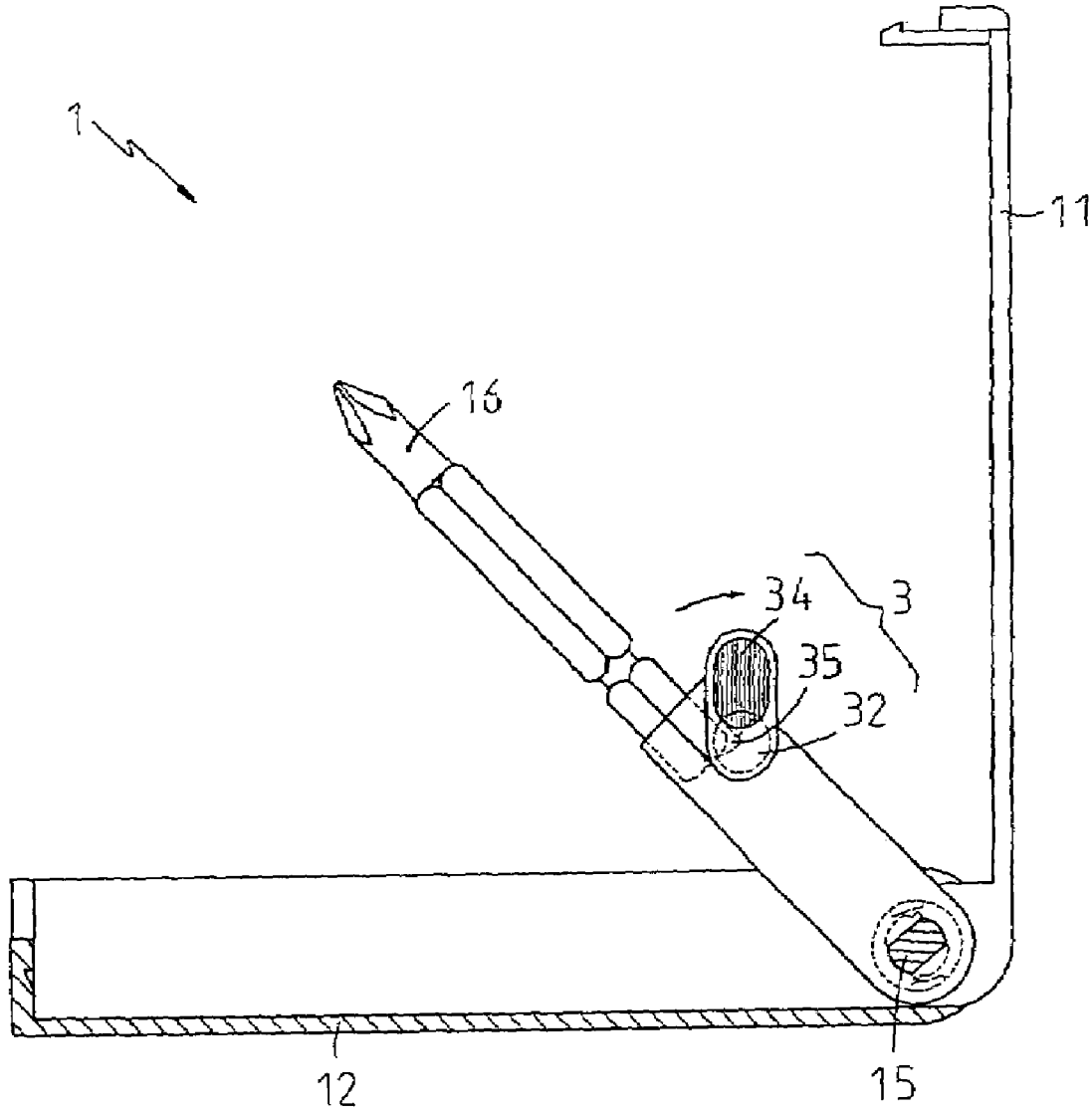
FIG. 8 shows that the tool is pushed upward by rotating the lever on the shaft.
Figure 9:
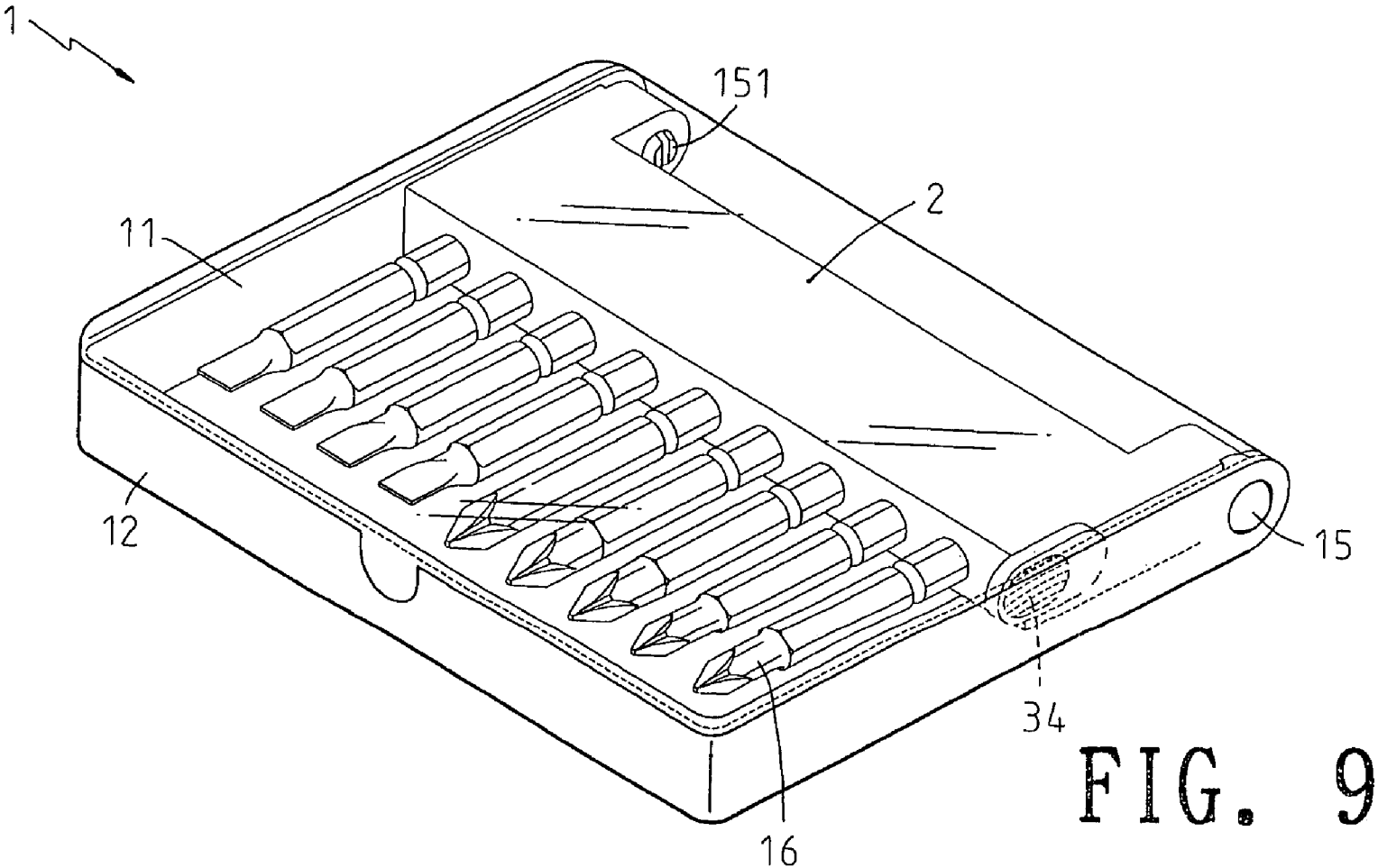
FIG. 9 is a perspective view to show the tool box with the tool rack in FIG. 7-1.

Referring to FIGS. 1 and 6, the tool box 1 of the present invention comprises a base 12 which includes three sidewalls and two holes are defined in two opposite sidewalls of the base 12. A cover 11 has two lugs on two sides thereof and the two lugs pivotably connected to two sides of the base 12 by extending two connection members 15 through the two lugs and the two holes in the two sidewalls of the base 12. The two lugs of the cover 11 each have a first polygonal hole 14.

A tool rack 2 is connected to the two lugs of the cover 11 and includes two protrusions extending from two lower ends thereof and each of the protrusions has a polygonal hole 23. Two connection members 15 each have a polygonal section extending from a head thereof and a slot is defined axially in the polygonal section so that the polygonal section is defined into two parts. Each part has a stop 151 extending laterally therefrom. The two respective polygonal sections of the two connection members 15 extend through the two holes in the two opposite sidewalls of the base 12, the two first polygonal holes 14 of the cover 11 and the two second polygonal holes 23 of the tool rack 2. The two respective stops 151 are engaged with the two respective end surfaces of the protrusions of the tool rack 2.

A plurality of through holes 21 are defined in a top of the tool rack 2 and a passage 22 is defined through the tool rack 2 and perpendicularly communicates with the through holes 21. A shaft 3 which is a cylindrical rod 32, rotatably extends through the passage 22 of the tool rack 2 and has a plurality of notches 31 defined in an outer periphery thereof. The notches 31 are located corresponding to the through holes 21 when the shaft 3 is rotated to a storage position. Each of the notches 31 is composed of a first inclined surface and a second inclined surface which intersects the first inclined surface. The first and second inclined surfaces have two different slopes. A small angle is defined between the first inclined surface and a vertical line perpendicular to the shaft 3, and a large angle is defined between the second inclined surface and the vertical line perpendicular to the shaft 3.

A lever 34 extends radially from a first end of the shaft and a recessed area is defined in one of two ends of the tool rack 2 and the lever 34 is pivotably engaged therewith. The lever 34 includes a boss 36 extending from an inside thereof and a concavity 37 is defined in a surface defining the recessed area so that the boss 36 can be removably engaged with the concavity 37. An enlarged head 332 is connected to a second end of the shaft 3 and located outside of the tool rack 2. A flange 331 extends radially from the second end of the shaft 3 and a gap is defined between the enlarged head 332 and the flange 131. The flange 331 is in contact with the outside of the tool rack 2 and deformable in the axial direction.

Figure 2:
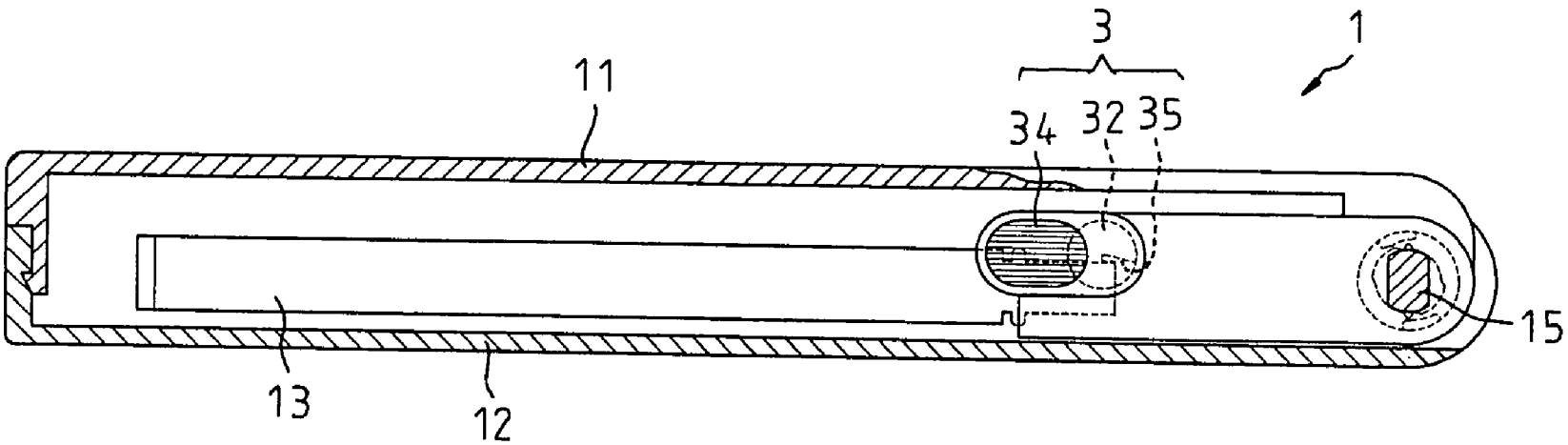
FIG. 2 is a side cross sectional view to show that the tool box is closed and the blades are engaged with the tool rack.
Figures 2, 3:
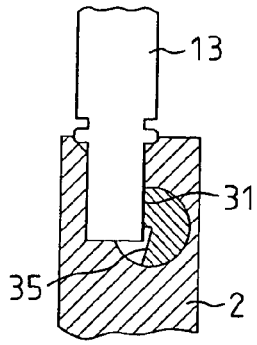

Referring to FIGS. 2, 2-1, 2-2 and 2-3, tools such as blades 13 can be inserted into the through holes 21 in the tool rack 2 and an end of the blades 13 are then in contact with the shaft 3 wherein the shaft 3 is at its open position and the lever 34 protrudes out from the tool rack 2. When the cover 11 is pivoted to close the tool box 1, the lever 34 is pushed by cover 11 and pivoted toward the recessed area in the tool rack 2. The shaft 3 is rotated an angle when the lever 34 is rotated and the ends of the blades 13 are then located in the notches 31. Along with the pivoting of the shaft 3, each of the notches 31 clamps a side of the end of the blades 13 which are well positioned in the tool box 1 without shaking. It is noted that, the direction that the shaft 3 rotates is to pull the blades 13 toward the shaft 3.

Figures 1, 5:
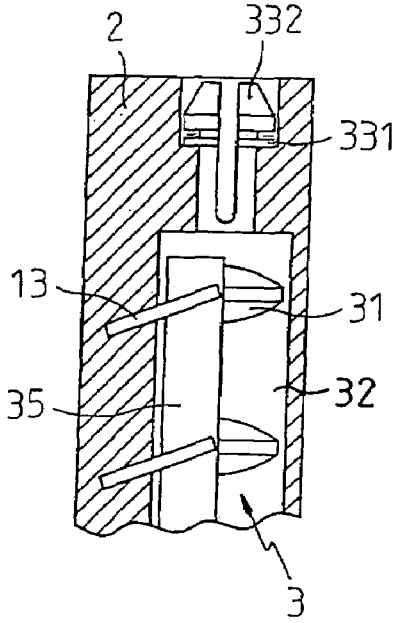
Figures 2, 5:
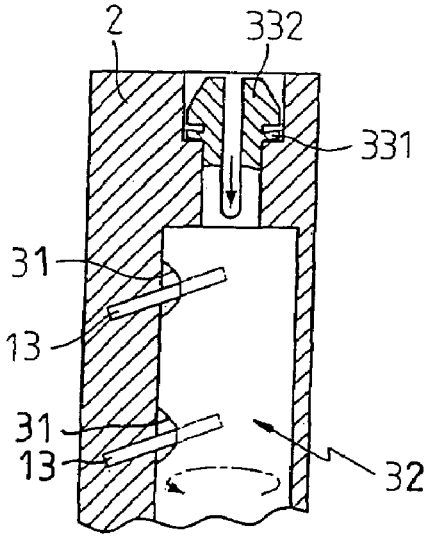

As shown in FIGS. 5-1, 5-2, if a thick blade 13 is to be clamped, the end of the blade 13 will contact the fit and second inclined surfaces of the notch 31 at higher positions so that when rotating the shaft 3, in order to clamp the thick blade 13, the gap is narrowed and the flange 331 is deformed, the shaft 3 is slightly moved in a direction to clamp the thick blade 13.

Figure 4:
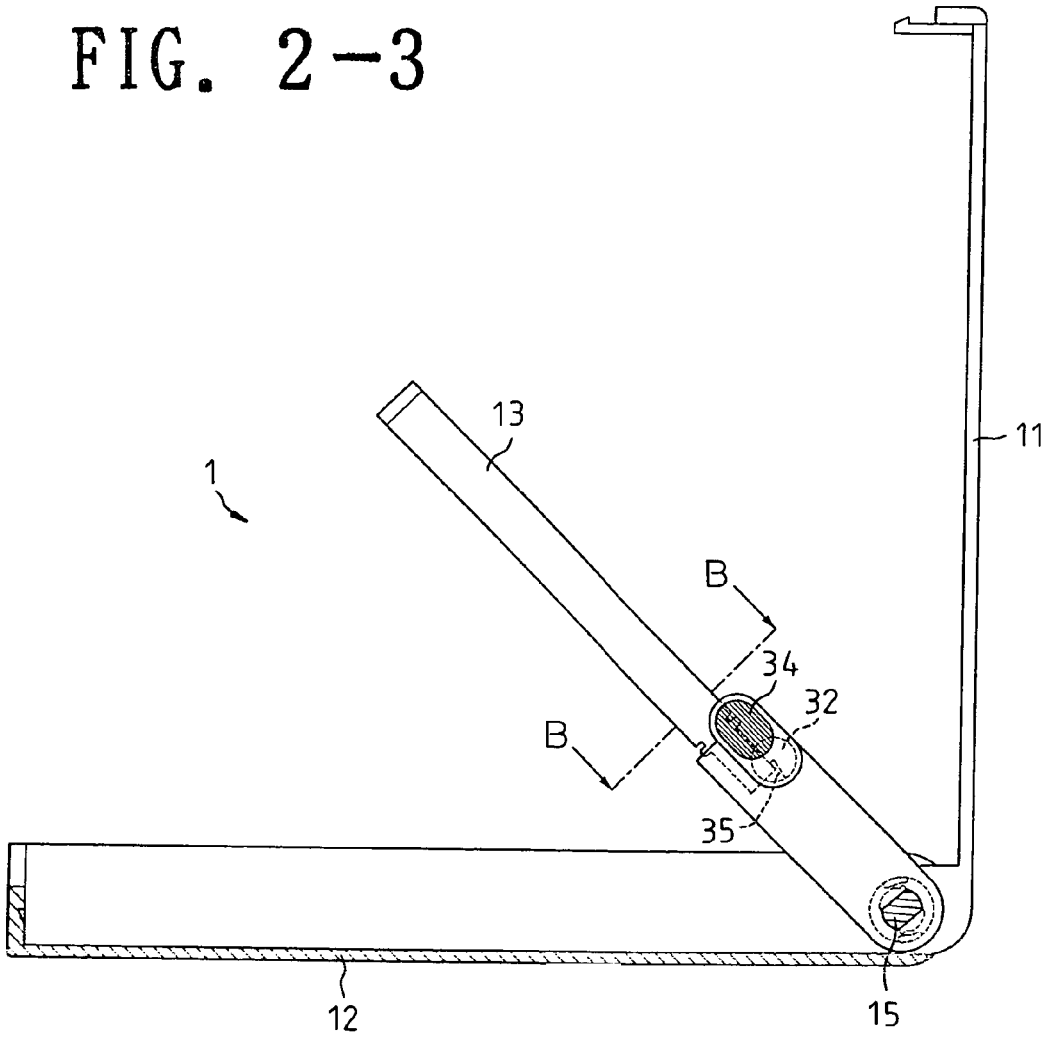
FIG. 4 shows that the cover is pivoted to open position and the lever of the shaft is rotated to clamp the tools by the notches in the shaft.

As shown in FIGS. 3 and 4, when the cover 11 is opened, the tool rack 2 is pivoted together with the cover 11 because of the connection members 15. The user may pivot die lever 34 away from the recessed area and the ends of the blades 13 in the notches 31 are pushed away from the shaft 3 by an inclined plane 35 communicating with the notches 31, so that the blades 13 are disengaged from the notches 31 and the blades 13 can be easily pulled out from the tool rack 2.

Referring to FIGS. 7-1, 7-2, 8 and 9, the tool rack 2 can be made to receive screw bits 16 wherein the through holes in the tool rack 2 is made to be a hexagonal holes and the notches of the shaft are made to be larger to clamp the screw bits 16.

While we have shown and described the embodiment in accordance with the present invention, it should be clear to those skilled in the art that further embodiments may be made without departing from the scope of the present invention.

What is claimed is:

1. A tool box comprising:

a base;

a cover having two lugs on two sides thereof and the two lugs pivotably connected to two sides of the base by extending two connection members through the two lugs and two sidewalls of the base, and a tool rack connected to the two connection members which are securely connected to the two lugs of the cover, a plurality of through holes defined in a top of the tool tack and a passage defined through the tool rack and communicating with the through holes, a shaft rotatably extending through the passage of the tool rack, a plurality of notches defined in an outer periphery of the shaft and located corresponding to the through holes when the shaft is rotated to a storage position.

2. The tool box as claimed in claim 1, wherein the two lugs of the cover each have a first polygonal hole and the tool rack has two protrusions with two second polygonal holes, the two connection members have two respective polygonal sections which extend through the two sidewalls of the base, the two first polygonal holes of the cover and the two second polygonal holes of the tool rack.

3. The tool box as claimed in claim 2, wherein each of the two connection members includes a slot defined axially in the polygonal section thereof so that the polygonal section is defined into two parts and each part has a stop extending laterally therefrom.

4. The tool box as claimed in claim 1, wherein the shaft includes a lever extending radially from a first end thereof and a recessed area is defined in two ends of the tool rack and the lever is pivotably engaged therewith.

5. The tool box as claimed in claim 4, wherein the lever includes a boss extending from an inside thereof and a concavity is defined in a surface defining the recessed area so that the boss is removably engaged with the concavity.

6. The tool box as claimed in claim 1, wherein an enlarged head is connected to a second end of the shaft and located outside of the tool rack, a flange extends radially from the second end of the shaft and a gap is defined between the enlarged head and the flange, the flange is in contact with the outside of the tool rack and deformable in the axial direction.

7. The tool box as claimed in claim 1, wherein the shaft is rotated to the storage position in a direction which is adapted to pull tools into the tool rack.

8. The tool box as claimed in claim 1, wherein each of the notches includes two inclined surfaces which intersects at a position and the two inclined surfaces have different slopes.

* * * * *